US011589698B2

(12) United States Patent
Chuang

(10) Patent No.: US 11,589,698 B2
(45) Date of Patent: Feb. 28, 2023

(54) HANGING WEIGHT STRUCTURE FOR A CURTAIN

(71) Applicants: ABO WINDOW FASHION CORP, Chino, CA (US); Shan-Chi Chuang, New Taipei (TW)

(72) Inventor: Shan-Chi Chuang, New Taipei (TW)

(73) Assignees: ABO WINDOW FASHION CORP., Chino, CA (US); Shan-Chi Chuang, New Taipei (TW)

( * ) Notice: Subject to any disclaimer, the term of this patent is extended or adjusted under 35 U.S.C. 154(b) by 130 days.

(21) Appl. No.: 17/239,668

(22) Filed: Apr. 25, 2021

(65) Prior Publication Data

US 2022/0338660 A1 Oct. 27, 2022

(51) Int. Cl.
*A47H 23/01* (2006.01)
*A47H 1/04* (2006.01)

(52) U.S. Cl.
CPC ..... *A47H 23/01* (2013.01); *A47H 1/04* (2013.01)

(58) Field of Classification Search
CPC .. A47H 23/01; A47H 23/02; A47H 2023/025; E06B 3/469; E06B 3/46; E06B 9/36; E06B 9/365; E06B 9/322; E05D 15/06; E05D 15/0656
See application file for complete search history.

(56) References Cited

U.S. PATENT DOCUMENTS 2,021,290 A * 11/1935 Chambers ..... B61D 19/005 49/125
2,833,346 A * 5/1958 Preston ..... E06B 3/922 160/197
3,262,488 A * 7/1966 Rieder ..... E06B 3/922 160/202
3,348,603 A * 10/1967 Ford ..... A47H 23/01 160/202
3,529,382 A * 9/1970 Salvarola ..... E06B 3/922 160/202
3,642,051 A * 2/1972 Goldner ..... E06B 3/922 160/199
3,911,991 A * 10/1975 Malferrari ..... A47H 13/00 160/202
6,892,783 B1 * 5/2005 Comeau ..... A47H 23/01 160/98
7,270,165 B1 * 9/2007 Chuang ..... E05D 15/0652 160/202
7,299,852 B1 * 11/2007 Chuang ..... A47H 23/04 160/222
7,458,410 B1 * 12/2008 Bronner ..... E05D 15/0656 160/214

(Continued)

*Primary Examiner* — Johnnie A. Shablack

(57) ABSTRACT

A hanging weight structure for a curtain has a hanging weight member, a connecting member, and two cover caps. The hanging weight member has two sides respectively mounted with the slot and the longer slot, and then each two hanging weight members are connected by a connecting member, so that each hanging weight member located at the lower portion of the curtain sheet is connected to each other through the connecting member to ensure the stability of the hem of the curtain sheet and maintain the curtain sheets being straight when they are collected or unfolded. Furthermore, a cover cap has the positioning rod that positioning the connecting member, which helps to improve the shading and dimming effect of the curtain sheets.

2 Claims, 7 Drawing Sheets

(56) References Cited

U.S. PATENT DOCUMENTS

| | | | | |
|---|---|---|---|---|
| 7,958,926 | B2 * | 6/2011 | Colson | E06B 9/36 160/168.1 V |
| 8,297,334 | B2 * | 10/2012 | Chu | E06B 9/36 160/202 |
| 10,743,698 | B1 * | 8/2020 | Chen | A47H 15/04 |
| 11,060,346 | B2 * | 7/2021 | Chuang | A47H 1/08 |
| 11,242,712 | B2 * | 2/2022 | Chuang | E06B 9/326 |
| 11,428,043 | B2 * | 8/2022 | Chuang | E06B 9/367 |
| 2007/0158036 | A1 * | 7/2007 | Lin | A47H 5/03 160/197 |
| 2007/0261799 | A1 * | 11/2007 | Chu | E06B 9/36 160/197 |
| 2008/0156951 | A1 * | 7/2008 | Lin | A47H 1/104 248/261 |
| 2008/0163986 | A1 * | 7/2008 | Li | A47H 23/04 160/175 |
| 2011/0030169 | A1 * | 2/2011 | Aebi | A47H 15/02 16/87.4 R |
| 2011/0036521 | A1 * | 2/2011 | Aebi | A47H 1/04 160/368.1 |
| 2019/0218857 | A1 * | 7/2019 | Chuang | A47H 23/02 |
| 2021/0007528 | A1 * | 1/2021 | Chuang | A47H 23/05 |
| 2021/0293086 | A1 * | 9/2021 | Chuang | A47H 23/05 |
| 2022/0275682 | A1 * | 9/2022 | Chuang | A47H 23/05 |

* cited by examiner

A-A

B-B

HANGING WEIGHT STRUCTURE FOR A CURTAIN

BACKGROUND OF INVENTION

Field of Invention

The present invention relates to a curtain structure, and more particularly to a hanging weight structure for a curtain.

Description of Related Art

Generally, indoor space has windows for ventilation and lighting, and curtains are usually installed on the windows to block sunlight, increase privacy, or as decoration. Mostly, curtains are made of fabric or sheet materials which are soft and flexible, so a hanging weight member is usually installed on the bottom edge of the curtain, and the weight of the hanging weight member keeps the curtain flat and down. However, when the hanging member is used for vertical curtains or curtains that are spread horizontally, the bottom hem of the curtain sheet often appear uneven or with tangles.

Therefore, it is desirable to provide a hanging weight structure for a curtain to mitigate and/or obviate the aforementioned problems.

SUMMARY OF INVENTION

An objective of present invention is to provide a hanging weight structure for a curtain, which is capable of improving the above-mention problems.

In order to achieve the above mentioned objective, A hanging weight structure for a curtain has a hanging weight member, a connecting member, and two cover caps. The hanging weight member has two sides respectively mounted with the slot and the longer slot, and then each two hanging weight members are connected by a connecting member, so that each hanging weight member located at the lower portion of the curtain sheet is connected to each other through the connecting member to ensure the stability of the hem of the curtain sheet and maintain the curtain sheets being straight when they are collected or unfolded. Furthermore, a cover cap has the positioning rod that positioning the connecting member, which helps to improve the shading and dimming effect of the curtain sheets.

Other objects, advantages, and novel features of invention will become more apparent from the following detailed description when taken in conjunction with the accompanying drawings.

DETAILED DESCRIPTION OF PREFERRED EMBODIMENT

Figure 1:
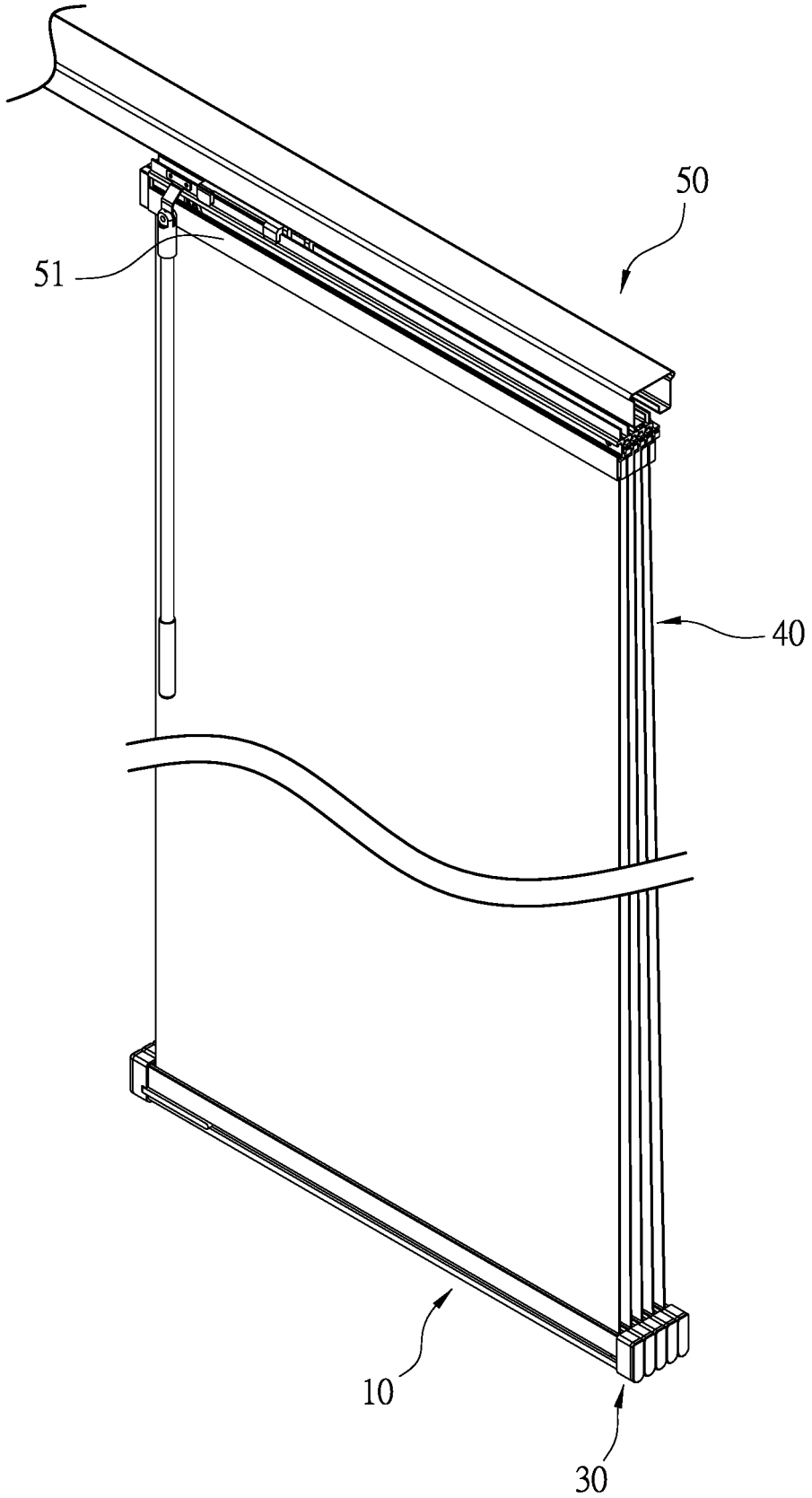
FIG. 1 is a perspective view of a preferred embodiment according to the present invention.
Figures 2, 3:
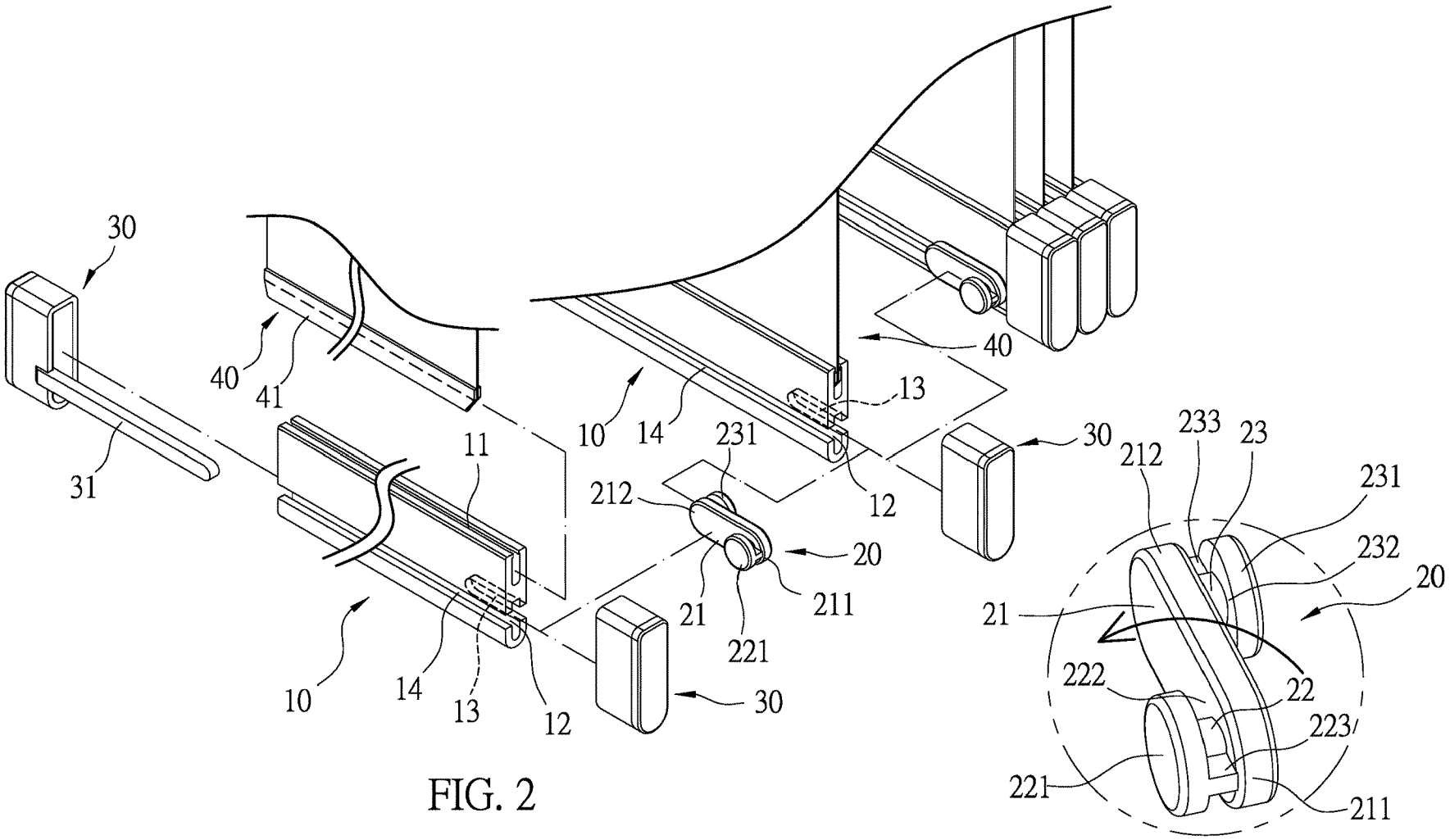
FIG. 2 is an exploded view of the preferred embodiment according to the present invention.
FIG. 3 is a partial enlarged schematic view of the connecting member of the preferred embodiment according to the present invention.

Please refer to FIGS. 1-3. A hanging weight structure for a curtain comprise: a hanging weight member 10, a connecting member 20 and two cover caps 30. A top portion of the hanging weight member 10 comprises an assembling slot 11 configured for accepting a curtain sheet 40, and a lower portion of the hanging weight member 10 comprises a horizontal hollow channel 12. Furthermore, a side of the lower portion of the hanging weight member 10 has a slot 13 at one end connected to the hollow channel 12, another side of the lower portion of the hanging weight member 10 has a longer slot 14 from end to end also connected to the hollow channel 12. The connecting member 20 has a main body 21 with a first end 211 and a second end 212. Moreover, a side of the main body 21 has a first shaft 22 at the first end 211, and another side of the main body 21 has a second shaft 23 at the second end 212. The first shaft 22 has a first roller 221, and the second shaft 23 has a second roller 231. Both of the first and second rollers 221, 231 are larger than the first shaft 22 and the second shaft 23, and a first ring groove 222 and a second ring groove 223 are respectively formed between the first and second rollers 221, 231 and the main body 21. A positioning column 223, 233 disposed in the first and second grooves 222, 232 is respectively connected to the first and second shafts 22, 23. The two cover caps 30 are respectively jacketed onto the two ends of the hanging weight member 10 and block the connecting member 20. One of the cover cap 30 has a positioning rod 31 toward the hanging weight member 10.

For the structure, please refer to FIGS. 2, 3, 4, 5, and 6. A curtain unit comprises an upper rail 50 and a plurality of sliding brackets 51 mounted on upper rail 50. A top portion of the curtain sheets 40 are respectively attached to the plurality of sliding brackets 51 mounted onto the upper rail 50 for synchronous expansion and retraction, and a lower end of the curtain sheet 40 is respectively equipped with a hanging weight member 10. The curtain sheets 40 are arranged as the slot 13 of the hanging weight member 10 facing the longer slot 14 on the lower end of the curtain sheets 40, and the assembling slot 11 is assembled with the curtain sheet 40. The assembling slot 11 of the hanging weight member 10 further comprises two ribs 111 correspondingly at two inner top ends, an assembling stripe 41 is disposed at a bottom portion of the curtain sheet 40 engaging with the assembling slot 111 of the hanging weight member 10, and the two ribs 111 prevent the assembling stripe 41 from releasing. The first shaft 22 of the connecting member 20 is disposed in the slot 13 of the hanging weight member 10, and the first roller 221 of the first shaft 22 is disposed in the hollow channel 112. The second shaft 23 is disposed in the longer slot 14 of the hanging weight member 10, and the second roller 231 of the second shaft 23 is disposed in the hollow channel 12 of the hanging weight member 10. Therefore, the two hanging weight members 10 are connected by the connecting member 20. The two cover caps 30 are respectively jacketed onto the two ends of the hanging weight member 10. One of the cover caps 30 has a positioning rod 31 toward the hanging weight member 10 and disposed at the end of the hanging weight member 10 without the slot 13, and the positioning rod 31 is disposed in the longer slot 14. The cover caps 30 block and limit the curtain sheets 40 and the connecting members 20, the longer slot 14 allows the second shaft 23 of the connecting member 20 to slide within, and the connecting members 20 are configure to connect the plurality of the hanging weight members 10 together, thereby preventing the hem of the curtain sheets 40 from being tangled and knotted.

Figure 4:
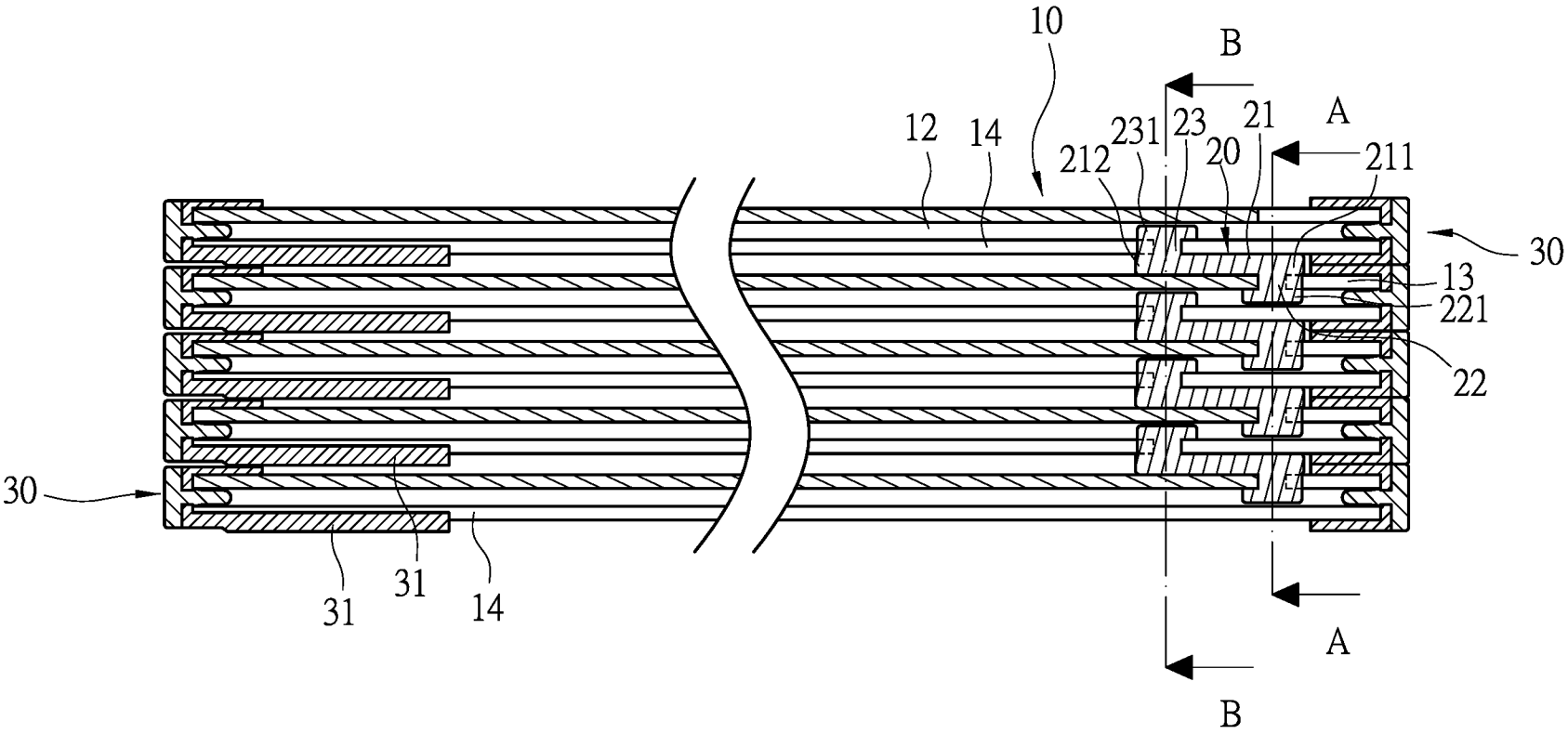
FIG. 4 is a sectional view of the combination of the preferred embodiment according to the present invention.
Figure 5:
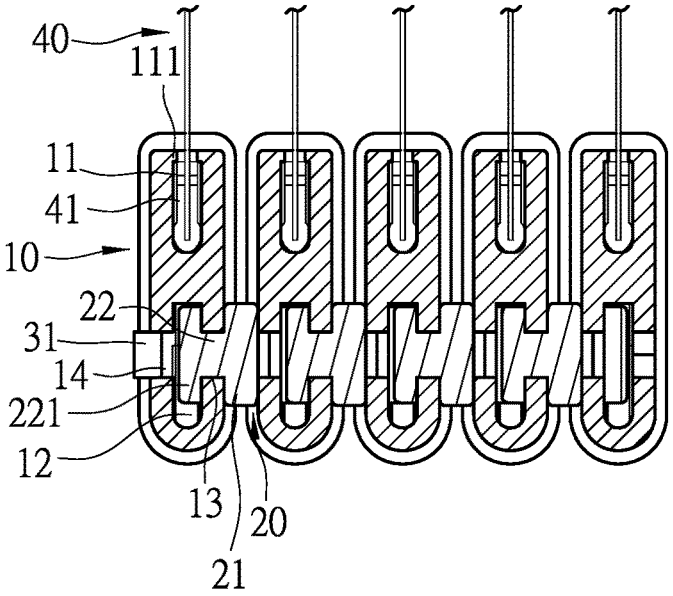
FIG. 5 is a cross-sectional view corresponding to the line A-A in FIG. 4 of the preferred embodiment according to the present invention.
Figure 6:
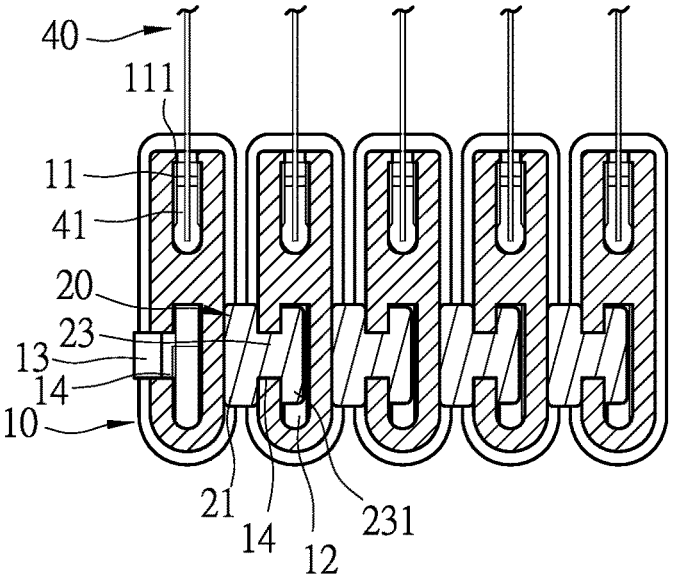
FIG. 6 is a cross-sectional view corresponding to the line B-B in FIG. 4 of the preferred embodiment according to the present invention.
Figure 7:
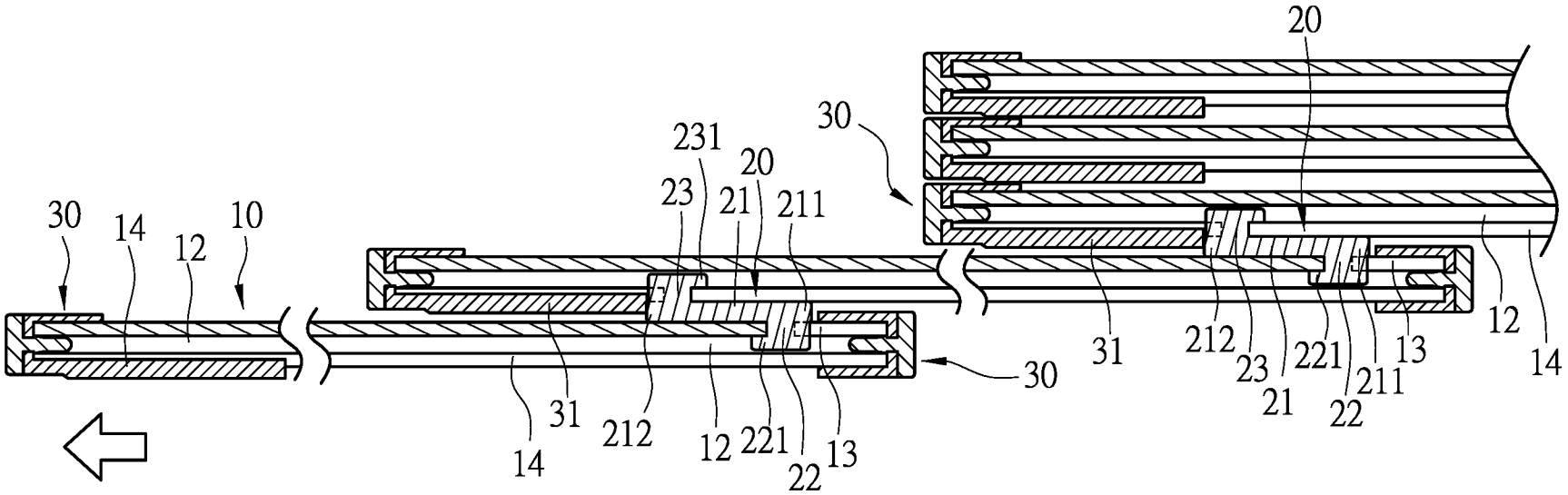
FIG. 7 is a schematic drawing of the interconnection of the hanging weight members of the preferred embodiment according to the present invention.

For the actual state of use, please refer to FIGS. 1, 4 and 7. When the curtain sheets 40 of the curtain unit are collected to one side of the upper rail 50 by the collection of the sliding brackets 51, the hanging weight member 10 at the lower end of the curtain sheets 40 are aligned side by side, each the connecting member 20 is located at one end of the hanging weight member 10, and the first end 211 of the main body 21 faces the cover cap 30 at the end. When the user pulls the sliding brackets 51 outward along the upper rail 50 and unfolds the curtain sheets 40 in sequence, the hanging weight members 10 are pulled out by the curtain sheet 40 and pulled out simultaneously. The connecting member 20 of the hanging weight member 10 located in the slot 13 slide along the longer slot 14 of the other hanging weight member 10 via the second shaft 23, and the connecting member 20 is moved to another end of the other hanging weight members 10. When the other curtain sheets 40 are continuously pulled out by the sliding brackets 51 and unfolded, the other hanging weight members 10 are also pulled out by the other the curtain sheets 40 to unfold the plurality of curtain sheets 40 continuously. When the curtain sheets 40 of the curtain unit are unfolded for shading purpose, the hems of the curtain sheets 40 are connected to each other through the hanging weight members 10 to prevent the curtain sheet from being winded and tangled.

In addition, when the hanging weight member 10 moves along the longer slot 14 of the other hanging weight members 10 by the connecting member 20, the other hanging weight members 10 further uses the positioning rod 31 of the other cover cap 30 to block the connecting member 20 which limits the distances that the hanging weight members 10 can be pulled out. At the same time, the length of the positioning rod 31 is used to increase the overlapping area of the curtains 30, thereby improving the shading effect of the curtain sheets.

Alternatively, when the curtain sheets 40 are collected together, each connecting members 20 of the hanging weight member 10 located in the slot 13 uses the second shaft 23 to reversely retract along the longer slot 14 of another hanging weight member 10. Therefore, when the other curtain sheets 40 are retracted in conjunction, the other hanging weight members 10 are also retracted and collected.

Figure 8:
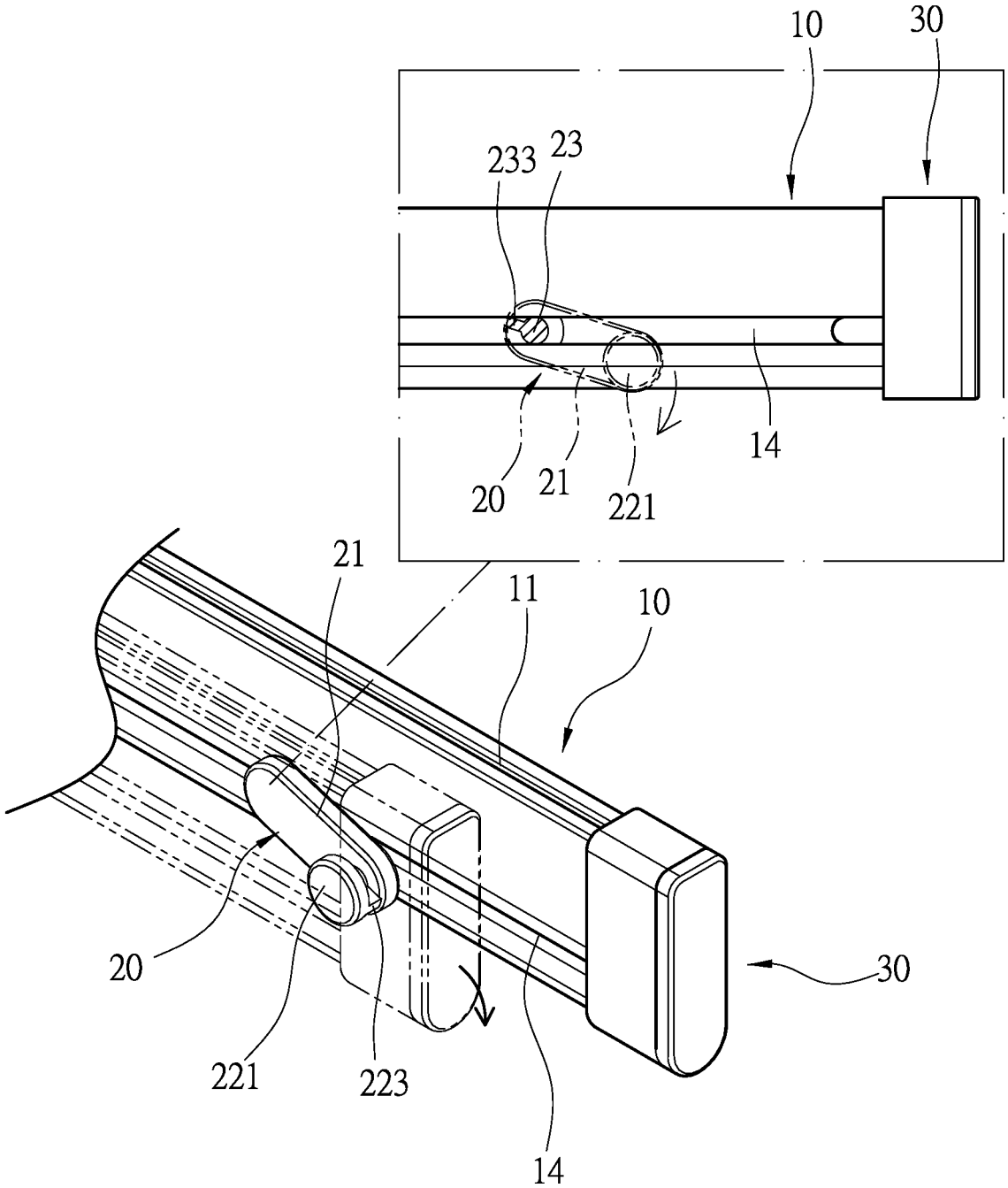
FIG. 8 is a schematic drawing showing the hanging weight member swinging upward by the connecting member according to the present invention.
Figure 9:
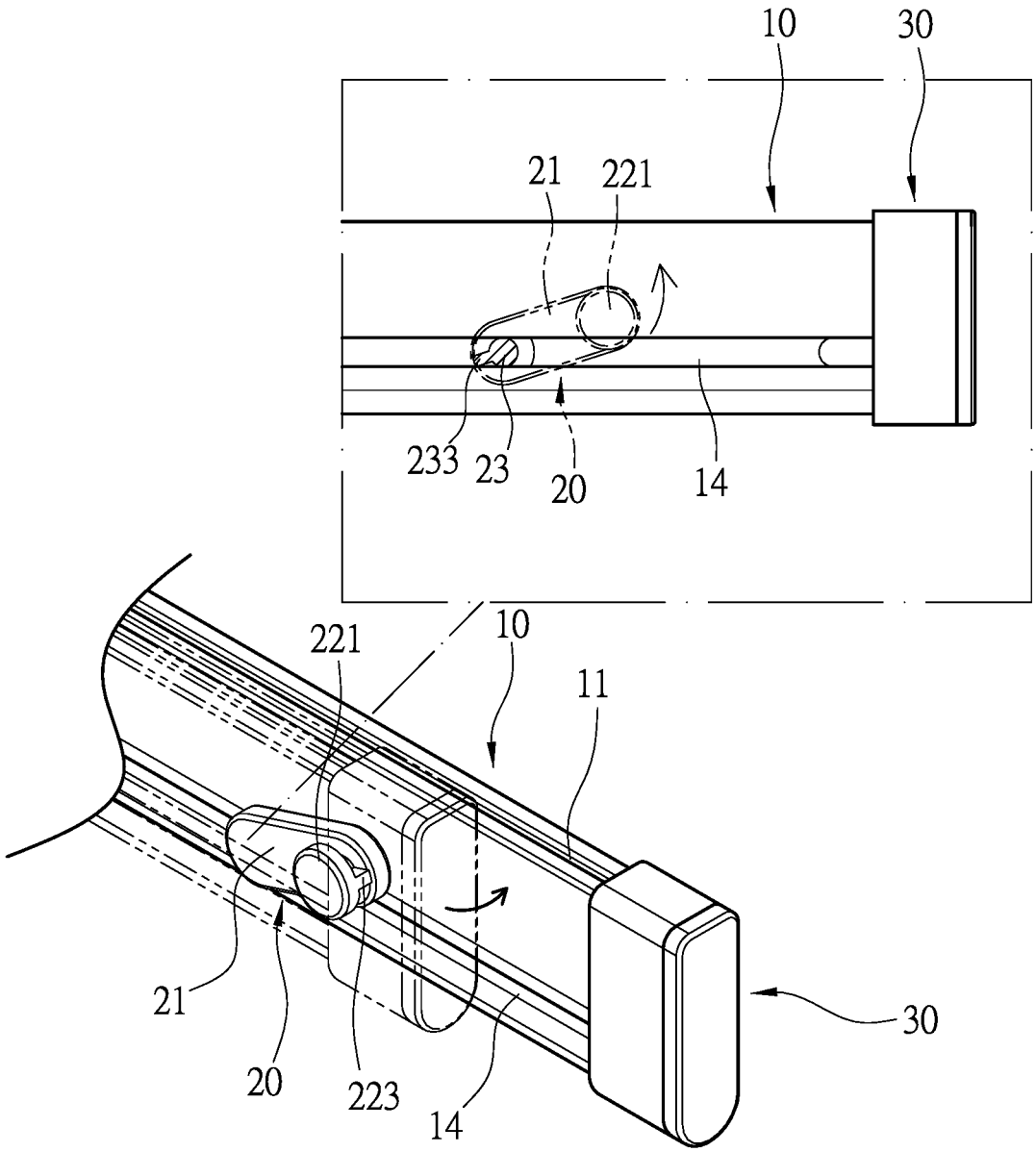
FIG. 9 is a schematic drawing showing the hanging member swinging downward by the connecting member according to the present invention.

Furthermore, as shown in FIGS. 8 and 9, the first and second shafts 22 and 23 of the connecting member 20 are able to rotate in the slot 13 and the longer slot 14 to make the hanging weight member 10 to rotate around the first shaft 22 or the second shaft 23 with the main body 21. When the curtain sheet 40 has a different length, the connecting member 20 is able to slightly adjust the height of the hanging weight member 10 to ensure the hanging weight member 10 is mounted on the lower portion of the curtain sheet. Moreover, the positioning columns 223 and 233 of the first and second shafts 22, 23 are blocked by the upper and lower end of the slot 13 and the longer slot 14 when the connecting member 20 rotates, which limits the rotation angle of the main body 21 and prevents the hanging weight member 10 from forming height difference due to the excessive swing of the connecting member 20.

With the structure of the above specific embodiment, the following benefits can be obtained: the hanging weight member 10 has two sides respectively mounted with the slot 13 and the longer slot 14, and then each two hanging weight members 10 are connected by a connecting member 20, so that each hanging weight member 10 located at the lower portion of the curtain sheet 40 is connected to each other through the connecting member 20 to ensure the stability of the hem of the curtain sheet 40 and maintain the curtain sheets 40 being straight when they are collected or unfolded. Furthermore, a cover cap 30 has the positioning rod 31 that positioning the connecting member 20, which helps to improve the shading and dimming effect of the curtain sheets.

Although the present invention has been explained in relation to its preferred embodiment, it is to be understood that many other possible modifications and variations can be made without departing from the spirit and scope of invention as hereinafter claimed.

What is claimed is:

1. A hanging weight structure for a curtain comprising: a hanging weight member, a connecting member, and two cover caps; a top portion of the hanging weight member comprising an assembling slot configured for accepting a curtain sheet, a lower portion of the hanging weight member comprising a horizontal hollow channel, a side of the lower portion of the hanging weight member having a slot at one end connected to the hollow channel, another side of the lower portion of the hanging weight member having a longer slot from end to end also connected to the hollow channel; the connecting member having a main body with a first end and a second end, a side of the main body having a first shaft at the first end, and another side of the main body having a second shaft at the second end; the first shaft having a first roller, the second shaft having a second roller, both of the first and second rollers being larger than the first shaft and the second shaft, a first ring groove and a second ring groove respectively formed between the first and second rollers and the main body, a positioning column respectively disposed in the first and second grooves, connected the first and second shafts, the first shaft disposed in the slot of the hanging weight member, and the first roller of the first shaft disposed in the hollow channel; the second shaft disposed in the longer slot of the hanging weight member, and the second roller of the second shaft disposed in the hollow channel of the hanging weight member; the two cover caps respectively jacketed onto the two ends of the hanging weight member and blocking the connecting member; one of the cover caps having a positioning rod toward the hanging weight member and disposed at the end of the hanging weight member without the shorter slot, and the positioning rod disposed in the longer slot, the connecting members configured to connect a plurality of the hanging weight members together.

2. The hanging weight structure for a curtain as claimed in claim 1, wherein the assembling slot of the hanging weight member further comprises two ribs correspondingly at two inner top ends, an assembling stripe disposed at a bottom portion of the curtain sheet engaging with the assembling slot of the hanging weight member, and the two ribs prevent the assembling stripe from releasing.

* * * * *